US005953022A

United States Patent [19]

Pickering et al.

[11] Patent Number: 5,953,022

[45] Date of Patent: Sep. 14, 1999

[54] MECHANICAL MICROFLUIDIC PRINTING ARRAY VALUE

[75] Inventors: James E. Pickering, Holcomb; Werner Fassler, Rochester; Charles D. DeBoer, Palmyra, all of N.Y.

[73] Assignee: Eastman Kodak Company, Rochester, N.Y.

[21] Appl. No.: 08/903,625

[22] Filed: Jul. 31, 1997

[51] Int. Cl.[6] ..... B41J 2/005

[52] U.S. Cl. ..... 346/140.1

[58] Field of Search ..... 347/43; 346/140.1

[56] References Cited

U.S. PATENT DOCUMENTS

| | | |
|---|---|---|
| 5,585,069 | 12/1996 | Zanzucchi et al. . |
| 5,593,838 | 1/1997 | Zanzucchi et al. . |
| 5,603,351 | 2/1997 | Cherukuri et al. . |
| 5,611,847 | 3/1997 | Guistina et al. . |

OTHER PUBLICATIONS

Dasgupta et al., "Electroosmosis: A Reliable Fluid Propulsion System for Flow Injection Analysis", Anal. Chem. 66, pp. 1792–1798 (1994).

*Primary Examiner*—N. Le
*Assistant Examiner*—Lamson D. Nguyen
*Attorney, Agent, or Firm*—Raymond L. Owens

[57] ABSTRACT

A microfluidic printing apparatus for printing ink pixels on a receiver includes at least one ink reservoir and plurality of microchannels each connected to the ink reservoir. The apparatus further includes a plurality of chambers associated with at least one microchannel which includes a resilient material which, in an ink delivery position, permits ink to be delivered from the microchannel to a chamber and in an ink printing position blocks the flow of ink from the microchannel to the chamber and reduces the size of the chamber to expel ink for printing on the receiver.

5 Claims, 5 Drawing Sheets

MECHANICAL MICROFLUIDIC PRINTING ARRAY VALUE

CROSS REFERENCE TO RELATED APPLICATIONS

The present invention is related to U.S. patent application Ser. No. 08/868,426 filed Jun. 3, 1997, entitled "Continuous Tone Microfluidic Printing" to DeBoer, Fassler, and Wen; U.S. patent application Ser. No. 08/868,416 filed Jun. 3, 1997 entitled "Microfluidic Printing on Receiver", to DeBoer, Fassler, and Wen; U.S. patent application Ser. No. 08/868,102, filed Jun. 3, 1997 entitled "Microfluidic Printing with Ink Volume Control" to Wen, DeBoer, and Fassler; U.S. patent application Ser. No. 08/868,477 filed Jun. 3, 1997 entitled "Microfluidic Printing with Ink Flow Regulation" to Wen, Fassler, and DeBoer; U.S. patent application Ser. No. 08/903,747, filed concurrently herewith entitled "Microfluidic Printing Array Valve" to Fassler, Pickering, and DeBoer; U.S. patent application Ser. No. 08/904,090, filed concurrently herewith entitled "Microfluidic Printing Array Valve with Multiple Use Printing Nozzles" to Fassler, Pickering, and DeBoer; and U.S. patent application Ser. No. 08/903,091, filed concurrently herewith entitled "High Resolution Microfluidic Printing Array Valve" to Fassler, Pickering, and DeBoer, all assigned to the assignee of the present invention. The disclosure of these related applications is incorporated herein by reference.

FIELD OF THE INVENTION

The present invention relates to printing high quality images by microfluidic pumping of colored inks into paper.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc. The system uses an array of micron sized reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analysis", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the accurate control of the print density. The problem comes about because the capillary force of the paper fibers is strong enough to remove all the ink from the device, draining it empty. If the paper is not removed from contact with the ink cells at the correct time, the print density will be too high or too low. Moreover, the correct paper contact time varies with the ambient temperature, making the timing problem more difficult.

It would be desirable to have a compact, low powered printer which could rapidly print a high quality image on plain paper with automatic control of the print density.

SUMMARY OF THE INVENTION

It is an object of this invention is to provide a rapid way to print a high quality image on plain paper.

Another object of this invention is to provide a compact, low power, portable printer.

These objects are achieved by a microfluidic printing apparatus for printing ink pixels on a receiver comprising:

a) at least one ink reservoir;

b) a plurality of microchannels each connected to the ink reservoir; and c) means defining a plurality of chambers associated with at least one microchannel which includes a resilient material which, in an ink delivery position, permits ink to be delivered from the microchannel to a chamber and in an ink printing position blocks the flow of ink from the microchannel to the chamber and reduces the size of the chamber to expel ink for printing on the receiver.

ADVANTAGES

The present invention provides high quality prints of the correct density on plain paper.

Another feature of the invention is that the printer is low power, compact and portable.

Another feature of the invention is that the printing process is fast, because all the pixels are printing simultaneously.

Another feature of the invention is that the printer is of low cost to manufacture, because the valves are controlled by mechanical power supplied by the operator.

DETAILED DESCRIPTION OF THE INVENTION

The present invention is described in relation to a microfluidic printing apparatus which can print computer generated images, graphic images, line art, text images and the like, as well as continuous tone images.

Figure 1:
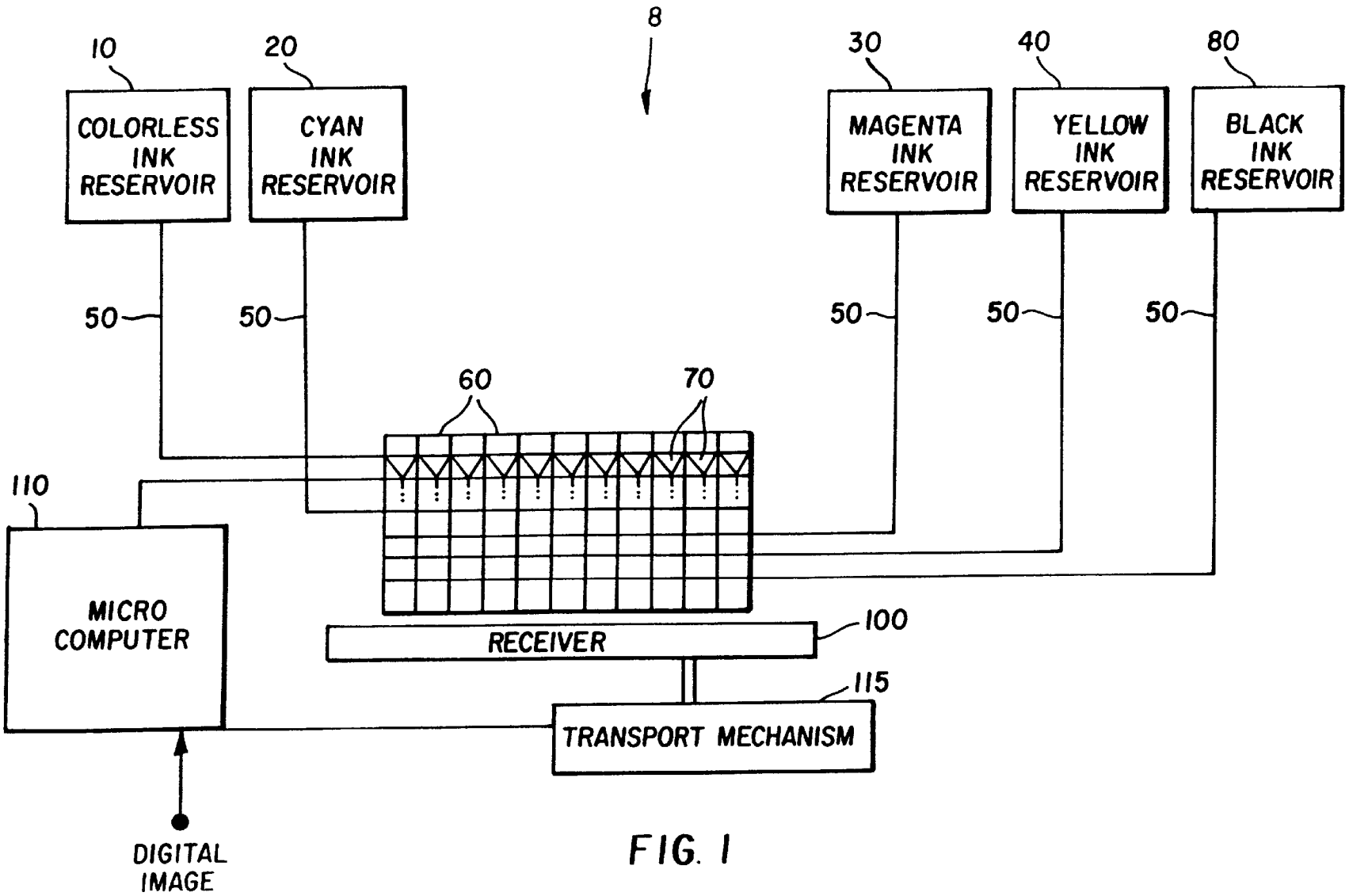
FIG. 1 is a partial schematic view showing a microfluidic printing system for printing a digital image on a reflective receiver.

Referring to FIG. 1, a schematic diagram is shown of a printing apparatus 8 in accordance with the present invention. Reservoirs 10, 20, 30, and 40 are respectively provided for holding colorless ink, cyan ink, magenta ink, and yellow ink. An optional reservoir 80 is shown for black ink. Microchannel capillaries 50 respectively connected to each of the reservoirs conduct ink from the corresponding reservoir to an array of ink mixing chambers 60. In the present invention, the ink mixing chambers 60 delivery the inks directly to a receiver; however, other types of ink delivery arrangements can be used such as microfluidic channels, and so when the word chamber is used, it will be understood to include those arrangements. The colored inks are delivered to ink mixing chambers 60 by electrokinetic pumps 70. The amount of each color ink is controlled by microcomputer 110 according to the input digital image. For clarity of illustration, only one set of electrokinetic pumps is shown for the colorless ink channel. Similar pumps are used for the other color channels, but these are omitted from the figure for clarity. Finally, a reflective receiver 100 is transported by a transport mechanism 115 to come in contact with the microfluidic printing apparatus. The receiver 100 receives the ink and thereby produces the print. Receivers may include common bond paper, made from wood fibers, as well as synthetic papers made from polymeric fibers. In addition receiver can be of non-fibrous construction, provided they absorb and hold the ink used in the printer.

Figure 2:
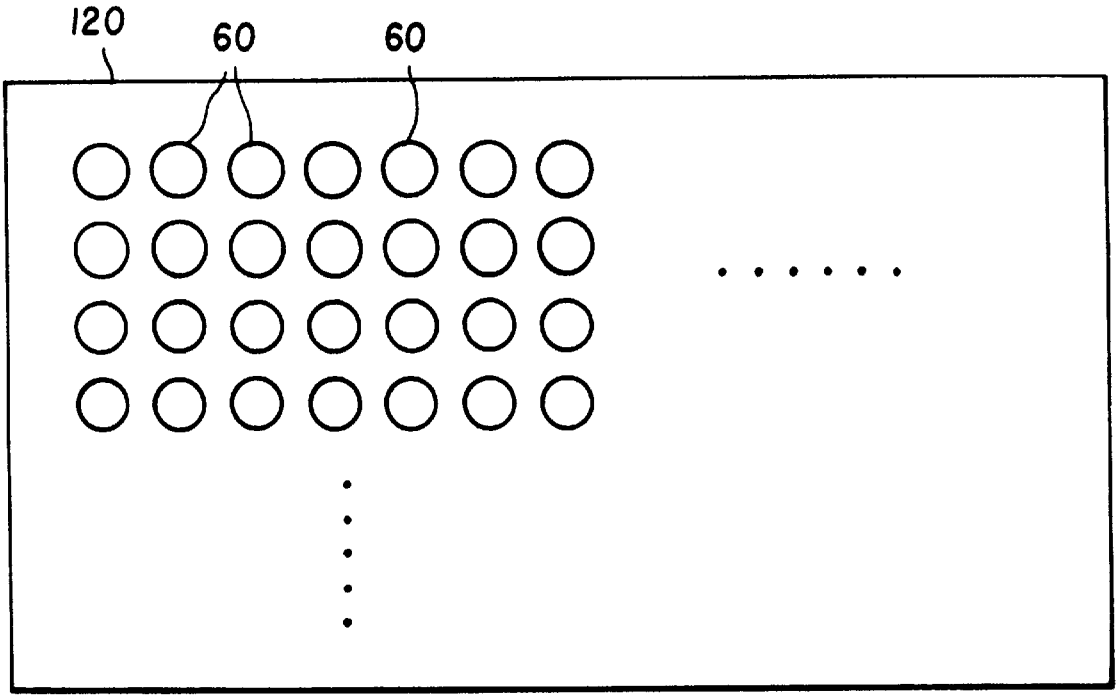
FIG. 2 is a top view of a pattern of the color pixels described in the present invention.

FIG. 2 depicts a top view of an arrangement of mixing chambers 60 shown in FIG. 1. Each ink mixing chamber 60 is capable of producing a mixed ink having any color saturation, hue and lightness within the color gamut provided by the set of cyan, magenta, yellow, and colorless inks used in the apparatus.

The inks used in this invention are dispersions of colorants in common solvents. Examples of such inks may be found is U.S. Pat. No. 5,611,847 by Gustina, Santilli, and Bugner. Inks may also be found in the following commonly assigned U.S. patent application Ser. No. 08/699,955 filed Aug. 20, 1996; U.S. patent application Ser. No. 08/699,962 filed Aug. 20, 1996; and U.S. patent application Ser. No. 08/699,963 filed Aug. 20, 1996 by McInerney, Oldfield, Bugner, Bermel, and Santilli; and in U.S. patent application Ser. No. 08/790,131 filed Jan. 29, 1997 by Bishop, Simons, and Brick; and in U.S. patent application Ser. No. 08/764,379 filed Dec. 13, 1996 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention.

The microchannel capillaries, ink pixel mixing chambers and microfluidic pumps are more fully described in the references listed above.

Figure 3:
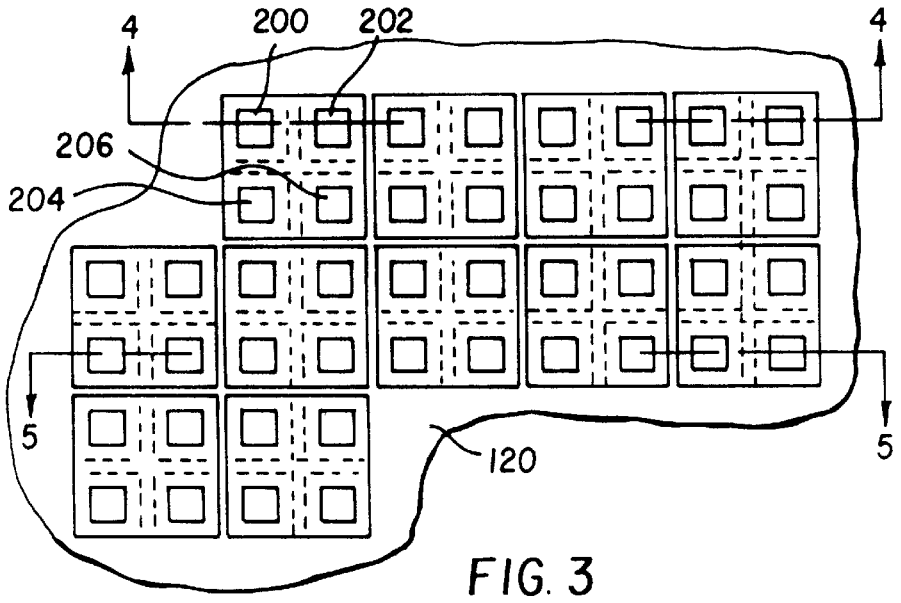
FIG. 3 is a top view of a second pattern of the color pixels described in the present invention.

FIG. 3 illustrates the arrangement of a second pattern of color pixels in the present invention. The ink mixing chambers 60 are fed by four microchannels of different colors; cyan ink orifice 200; magenta ink orifice 202; yellow ink orifice 204; and black ink orifice 206. Each orifice is connected only to the respective colored ink reservoir and to the colorless ink reservoir 10. For example, the cyan ink orifice 200 is connected to the cyan ink reservoir and the colorless ink reservoir so that cyan inks can be mixed to any desired lightness. When the inks are transferred to the reflective receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Figure 4:
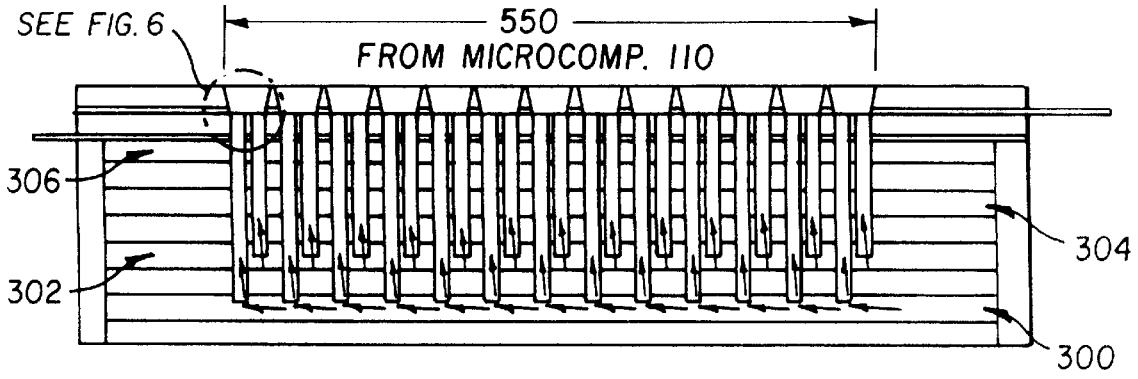
FIG. 4 is a cross-sectional view taken along the lines 4—4 of the microfluidic printing apparatus in FIG. 3.
Figure 5:
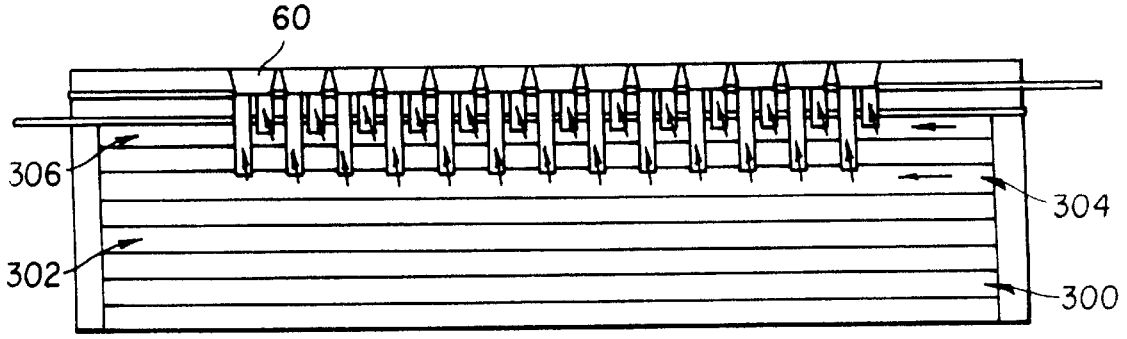
FIG. 5 is another cross-sectional view taken along the lines 5—5 of the microfluidic printing apparatus in FIG. 3.

Cross-sections of the color pixel arrangement shown in FIG. 3 are illustrated in FIG. 4 and FIG. 5. The colored ink supplies 300, 302, 304, and 306 are fabricated in channels parallel to the printer front plate 120. The cyan, magenta, yellow and black inks are respectively delivered by colored Ink supplies 300, 302, 304, and 306 into each of the colored ink mixing chambers.

Figure 6:
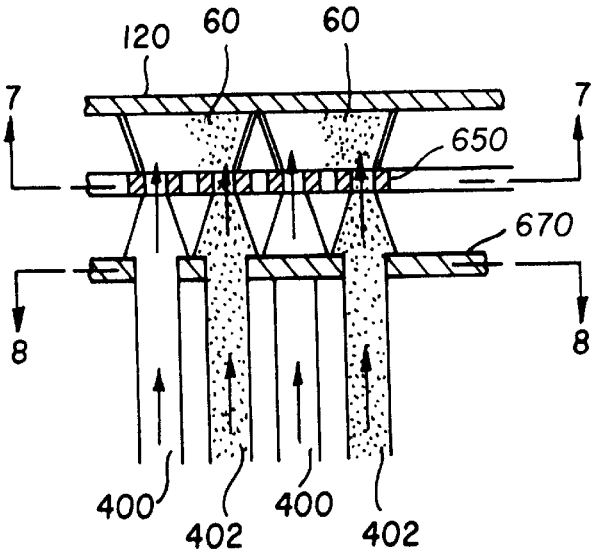
FIG. 6 is an enlarged view of the circled portion of FIG. 4.
Figure 7:
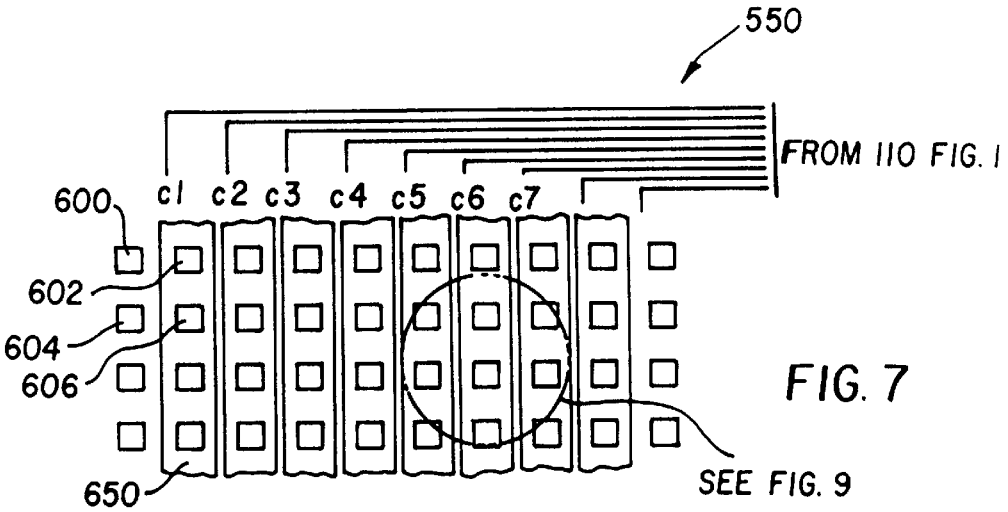
FIG. 7 is a top view of the micronozzles shown in FIG. 6.
Figure 8:
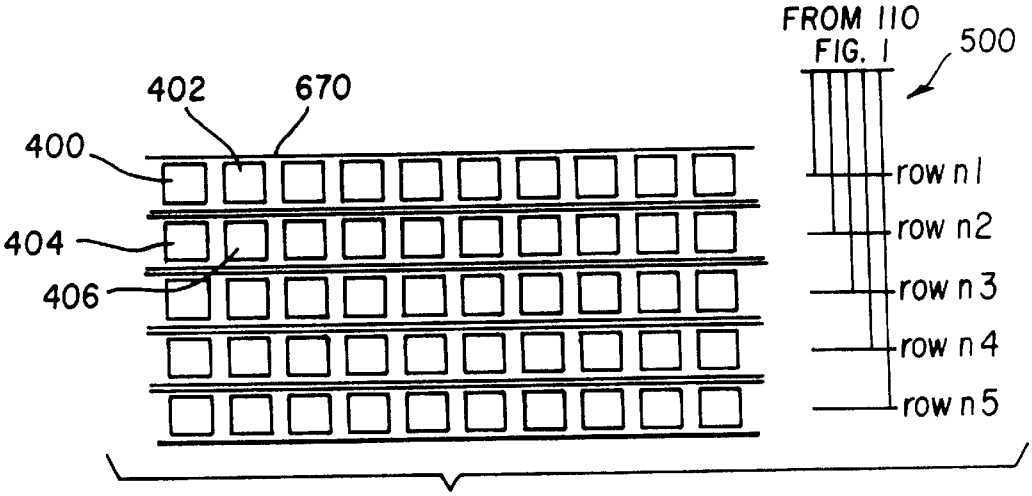
FIG. 8 is a top view of the microchannel and showing conducting circuit connections in FIG. 6.

A detailed view of the cross-section in FIG. 4 is illustrated in FIG. 6. The colored inks are delivered to the ink mixing chambers respectively by cyan, magenta, yellow, and black ink microchannels 400, 402, 404, and 406 (404 and 406 do not show up in the plan shown in FIG. 6, but is illustrated in FIG. 8) The colored ink microchannels 400, 402, 404, and 406 are respectively connected to the colored ink supplies 300, 302, 304, and 306 (FIGS. 4 and 5). The colorless ink is supplied to the ink mixing chamber, but is not shown in FIG. 6 for clarity of illustration. A cross-section view of the plane containing the micronozzles in FIG. 6 is shown in FIG. 7. The cyan, magenta, yellow, and black ink micronozzles 600, 602, 604, and 606 are distributed in the same arrangement as the colored ink micro channels 300–304 and the colored ink mixing chambers 200–206. The column electrodes 650 are shown connected to the conducting circuit 550, which is further connected to microcomputer 110.

A cross-section view of the plane containing the microchannels in FIG. 6 is shown in FIG. 8. The color ink channels 400–406 are laid out in the spatial arrangement that corresponds to those in FIGS. 3 and 7. The lower electrodes in the electrokinetic pumps for delivering the colored inks are not shown for clarity of illustration. The row electrodes 670 are connected to lower electrodes of the electrokinetic pumps. The row electrodes 670 are shown connected to the conducting circuit 500, which is further connected to microcomputer 110.

The operation of a microfluidic printer comprises the steps of activating the electrokinetic pumps to pump the correct amount of each color ink to the mixing chamber to provide a pixel of the correct hue and intensity corresponding to the pixel of the scene being printed. The receiver is then contacted to the mixing chambers and capillary or absorption forces draw the ink from the mixing chambers to the receiver. The receiver is then removed from contact with the mixing chambers and allowed to dry. Timing of the removal of the receiver is critical to prevent excess ink to be drawn from the microchannels that feed the mixing chambers.

Figure 9:
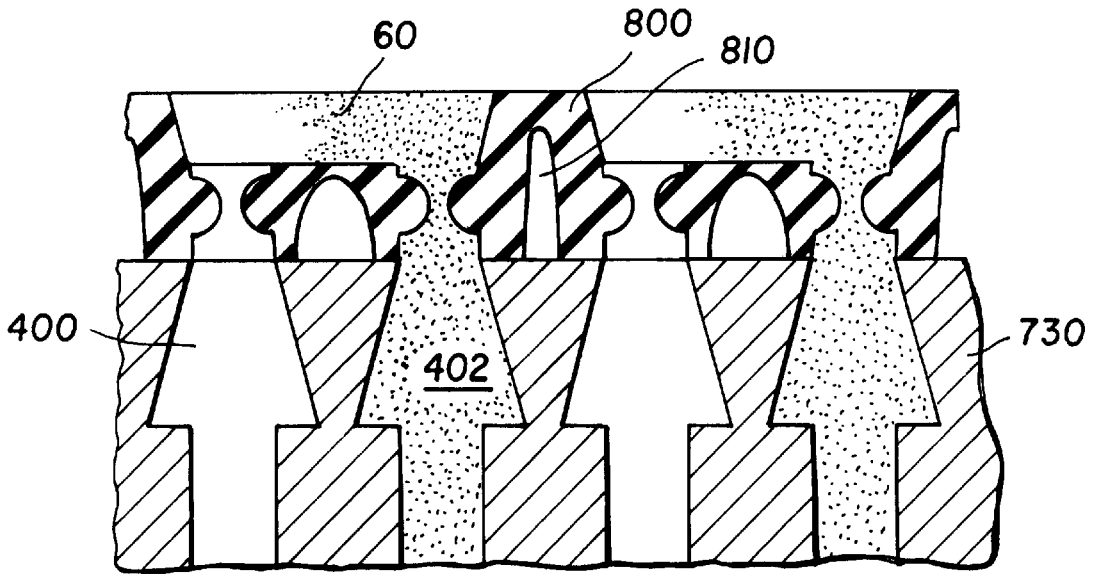
FIG. 9 is an enlarged cross sectional view of the ink mixing chambers of FIG. 6, showing the open printing nozzles.
Figure 10:
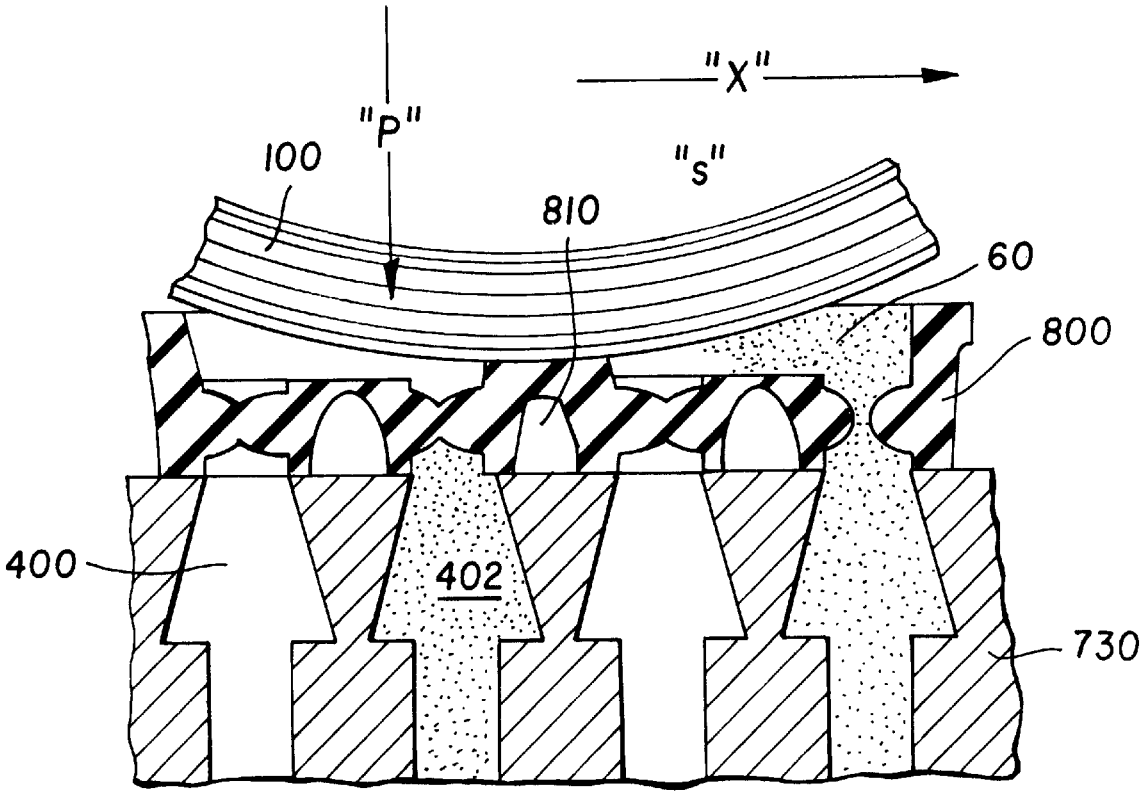
FIG. 10 is a cross sectional view similar to FIG. 9 showing the pressure plate actuating the closing of the printing nozzles.

The preferred embodiment of this invention is illustrated in FIG. 9. A resilient shutter plate 800, formulated from a resilient material such as, but not limited to, silicon rubber, is contiguously disposed over the ink supply plate 730, in alignment with the ink supply microchannels 400 and 402. The remaining ink supply microchannels are not shown for clarity of the drawing, nor are the electrodes and the electrokinetic pumps. In the "on" position shown in FIG. 9, the necessary amounts of the colored inks can be pumped into the mixing chambers 60 to correspond to the hue and intensity of the pixels of the scene being printed. Then the receiver is brought into contact with the resilient shutter plate with enough force to cause the openings for the ink to close, as shown in FIG. 10. This is possible because of the openings to the atmosphere 810, which allow resilient movement of the shutter plate 800. The closed opening for ink prevent excess ink transfer from the microchannels and insure an accurate representation of the printed scene. The pressure, indicated by vector "P", is supplied by the operator. In a preferred embodiment of the invention a roller is moved across; the receiver in the direction indicated by the vector "x". The result of the compression caused by the pressure "p" of the roller is to shut the valve as indicated by "s". The other effect of the pressure is to ensure contact between the receiver and the ink in the mixing chamber 60, which eliminates drop-outs and missing pixels in the final print.

The invention has been described in detail with particular reference to certain preferred embodiments thereof, but it will be understood that variations and modifications can be effected within the spirit and scope of the invention.

Parts List

8 microfluidic printing system
10 colorless ink reservoir
20 cyan ink reservoir
30 magenta ink reservoir
40 yellow ink reservoir
50 microchannel capillaries
60 ink mixing chambers or printing nozzles
70 electrokinetic pumps
80 black ink reservoir
100 receiver
110 microcomputer
115 transport mechanism
120 printer front plate
200 cyan ink orifice
202 magenta ink orifice
204 yellow ink orifice
206 black ink orifice
300 cyan ink supply
302 magenta ink supply
304 yellow ink supply
306 black ink supply
400 cyan ink microchannel
402 magenta ink microchannel
404 yellow ink microchannel
406 black ink microchannel
500 conducting circuit
550 conducting circuit
600 cyan ink microorifice Parts List (con't)

602 magenta ink microorifice
604 yellow ink microorifice
606 black ink microorifice
650 column electrodes
670 row electrodes
730 ink supply plate
800 resilient shutter plate
810 open to the atmosphere

What is claimed is:

1. A microfluidic printing apparatus for printing ink pixels on a receiver comprising:

a) at least one ink reservoir;

b) a plurality of microchannels each connected to the ink reservoir; and c) means for defining a plurality of chambers associated with at least one microchannel of said plurality of microchannels, and means for defining a plurality of resilient shutter plates which includes a resilient material which is effective, in an ink delivery position, to permit ink to be delivered from said plurality of microchannels to said plurality of chambers and is movable to an ink printing position which blocks the flow of ink from said plurality of microchannels to said plurality of chambers and reduces the size of said plurality of chambers to expel the ink for printing an image on the receiver.

2. The microfluidic printing apparatus according to claim 1 further including:

a) a plurality of microfluidic pumps each being associated with a single microchannel of said plurality of microchannels for supplying ink from the ink reservoir to a particular chamber of said plurality of chambers; and b) control means for controlling the microfluidic pumps and including a roller which is effective to compress the resilient material of the resilient shutter plates when the image is to be transferred to the receiver.

3. A microfluidic printing apparatus for printing ink pixels on a receiver comprising:

a) at least one ink reservoir;

b) a plurality of microchannels each connected to the ink reservoir; and c) a plurality of resilient shutter plates formed of a resilient material and defining a plurality of chambers associated with at least one microchannel of said plurality of microchannels which is effective in an ink delivery position to permit ink from the ink reservoir to be delivered from said plurality of microchannels to said plurality of chambers and is movable to an ink printing position to block the flow of ink from said plurality of microchannels to said plurality of chambers and reduces the size of said plurality of chambers to expel the ink for printing an image on the receiver.

4. The microfluidic printing apparatus according to claim 3 further including:

a) a plurality of microfluidic pumps each being associated with a single microchannel of said plurality of microchannels for supplying ink from the ink reservoir to a particular chamber of said plurality of chambers; and b) control means for controlling the microfluidic pumps and including a roller which is effective to compress the resilient material of the resilient shutter plates when the image is to be transferred to the receiver.

5. A microfluidic printing apparatus for printing ink pixels on a receiver comprising:

a) a plurality of ink reservoirs containing colored inks;

b) a plurality of microchannels each connected to a single ink reservoir; and c) a plurality of resilient shutter plates formed of a resilient material and defining a plurality of chambers; and d) the resilient shutter plates being effective in an ink delivery position to permit ink from the ink reservoirs to be delivered from said plurality of microchannels to said plurality of chambers where the colored inks are mixed and in an ink printing position to block the flow of ink from said plurality of microchannels to said plurality of chambers and reduces the size of said plurality of chambers to expel the ink for printing an image on the receiver.

* * * * *

UNITED STATES PATENT AND TRADEMARK OFFICE

CERTIFICATE OF CORRECTION

PATENT NO. : 5,953,022
DATED : September 14, 1999
INVENTOR(S) : James E. Pickering, et al It is certified that error appears in the above-identified patent and that said Letters Patent is hereby corrected as shown below:

| | |
|---|---|
| Face of patent, Section [54] Title | Delete "MECHANICAL MICROFLUIDIC PRINTING ARRAY VALUE" and substitute with --MECHANICAL MICROFLUIDIC PRINTING ARRAY VALVE-- |

Signed and Sealed this

First Day of August, 2000

*Attest:*

*Attesting Officer*

Q. TODD DICKINSON

*Director of Patents and Trademarks*